United States Patent [19]

Yoshida et al.

[11] Patent Number: 4,760,221

[45] Date of Patent: Jul. 26, 1988

[54] MULTIPLE CONTACT SWITCH

[75] Inventors: Hatsuyoshi Yoshida; Mitsutoshi Higuchi; Minoru Nishio; Koji Hirai; Shigeo Nakamura; Shinichi Hikita, all of Aichi, Japan

[73] Assignee: Kabushiki Kaisha Tokai Rika Denki Seisakusho, Aichi, Japan

[21] Appl. No.: 3,554

[22] Filed: Jan. 15, 1987

[30] Foreign Application Priority Data

Jun. 19, 1986 [JP] Japan ..... 61-93547[U]

[51] Int. Cl.[4] ..... H01H 13/52

[52] U.S. Cl. ..... 200/67 D; 200/5 A; 200/159 A

[58] Field of Search ..... 200/1 R, 1 A, 5 R, 5 A, 200/6 R, 6 B, 6 BA, 6 BB, 6 C, 16 B, 67 D, 67 DA, 72, 159 R, 159 A, 160, 283, 330, 339, 340

[56] References Cited

U.S. PATENT DOCUMENTS

| | | | |
|---|---|---|---|
| 3,731,032 | 5/1973 | Schantz | 200/6 BB X |
| 3,982,086 | 9/1976 | Marquardt et al. | 200/67 DA |
| 4,055,734 | 10/1977 | Hayden | 200/340 X |
| 4,343,973 | 8/1982 | Main | 200/5 A X |
| 4,401,864 | 8/1983 | Ichikawa | 200/339 X |
| 4,438,304 | 3/1984 | Kennedy | 200/5 A X |

*Primary Examiner*—J. R. Scott

*Attorney, Agent, or Firm*—Finnegan, Henderson, Farabow, Garrett & Dunner

[57] ABSTRACT

A multiple contact switch having at least one elastically deformable contact spring that is deformed by means of projections from a plunger to initiate contact with normally-open electrical contacts within the switch. A normally-closed contact piece within the switch also confronts the normally-open contact. Upon deformation of the elastically deformable spring contact, contacts are made and interrupted by means of contacts affixed to the movable contact springs.

6 Claims, 4 Drawing Sheets

MULTIPLE CONTACT SWITCH

BACKGROUND OF THE INVENTION

1. Field of the Invention

This invention relates to a multiple contact switch with a reversible spring member curved in a predetermined direction which, upon depression, is elastically curved in the opposite direction.

2. Description of the Prior Art

It is conventional for a switch to use a reversible leaf spring so that the periphery of the reversible leaf spring is supported by a first contact in the form of a ring, and a second contact is arranged at the center of the first contact. Upon depression by a push rod, the reversible leaf spring is elastically curved downwardly to contact the second contact, so that the switch is turned on. During this operation the operator can feel the switch operate. When the pressure on the push rod is removed, the reversible leaf spring curves upwardly to its original configuration so that the switch is again turned off. Such switches are extensively employed as signal inputting means in the field of electronics.

Recently, another type of multiple contact switch has been developed in which a third contact is provided above the second contact and actuated by a push rod. The reversible leaf spring in such a switch is normally held in contact with the third contact, so that the second contact is employed as a normally-open side contact and the third contact is employed as a normally-closed side contact.

The movement of the reversible leaf spring in such a switch is extremely small, generally 0.2 to 0.3 mm. Therefore, in order to stabilize the contact pressure of the reversible leaf spring on the third contact which is the normally-closed side contact, it is necessary to assemble the switch in such a manner that the distance between the first contact and the third contact is maintained at a constant amount with extremely high accuracy. However, it is difficult for conventional manufacturing techniques to satisfy this requirement, and this makes it difficult to put such a switch into practical use.

In view of the foregoing, an object of this invention is to provide a multiple contact switch in which the contact pressure of the reversible spring member on the normally-closed side contact piece is maintained at a stable value. It is a further object to provide a switch which can be assembled readily without need for high accuracy and can, therefore, be readily put in practical use.

SUMMARY OF THE INVENTION

To achieve these and other objects of the invention, there is provided a switch. The switch includes a case, an insulating substrate supported in the case and a normally-open contact that is secured to the insulating substrate. A normally-closed contact piece is secured to the insulating substrate in such manner as to confront the normally-open contact. A movable contact spring having an end portion formed into a reversible curved spring portion is curved toward the normally-closed contact piece. The contact spring further has legs extending from the reversible spring portion, the legs being in contact with the insulating substrate. The reversible curved spring portion has a contact member normally held in contact with the normally-closed contact piece by the elastic force of the movable contact spring. At least one plunger in the case has a pair of projections on each side of the normally-closed contact piece. Depression of the plunger and the pair of projections depresses the reversible spring portion of the movable contact piece, thereby curving the reversible spring portion towards the normally-open contact. The contact member on the reversible spring portion is thereby brought into contact with the normally-open contact. Preferrably, the movable contact spring is Y-shaped with the legs comprising two extremities of the contact spring. The end of the contact spring opposite the legs is fastened to the substrate. It is also preferred that the contact piece be T-shaped with each extremity of the piece being fastened to the substrate. It is further preferred that the reversible curved spring portion have a convex surface facing the plunger when the plunger and the projections are separated therefrom. It is further preferred that the projections elastically deform the reversible curve spring portion upon movement of the plunger such that the spring portion is concave facing the plunger.

The present invention will now be disclosed in terms of preferred embodiments as depicted in the following drawings.

BRIEF DESCRIPTION OF THE DRAWINGS

The following figures show a window regulator switch for automobiles which is one embodiment of this invention. More specifically.

DESCRIPTION OF THE PREFERRED EMBODIMENTS

A first embodiment of this invention which is used to control a window regulator will be described with reference to FIGS. 1 through 4.

Figure 1:
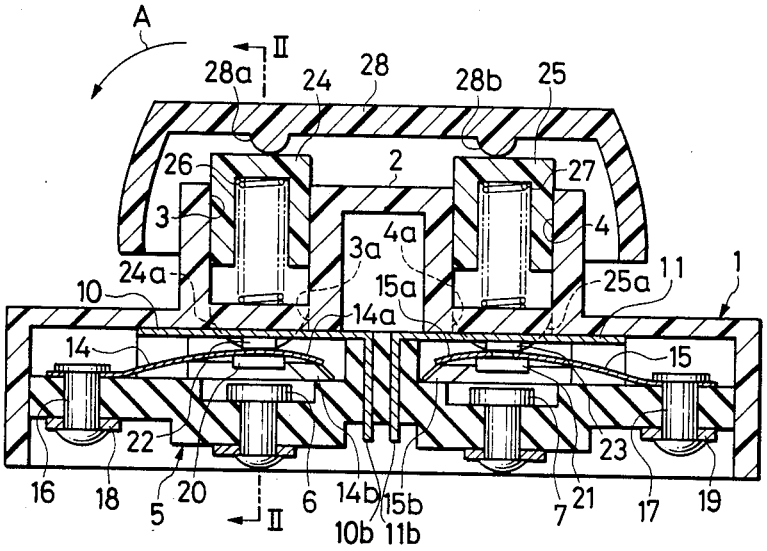
FIG. 1 is a vertical sectional view of a switch made in accordance with the invention.
Figure 2:
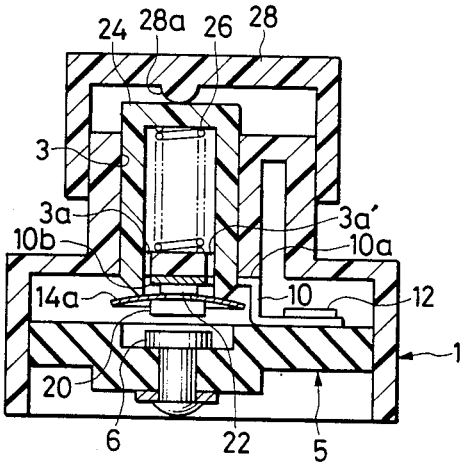
FIG. 2 is a sectional view taken along line II—II in FIG. 1.

The switch of this embodiment includes a rectangular-box-shaped plastic case 1 having an open bottom. A rectangular protrusion 2 extends upwardly from the top of the plastic case 1, and has two rectangular guide openings 3 and 4 on either side thereof. As depicted in FIG. 2, the rectangular guide opening 3 has two opposite side openings 3*a* and 3*a'* on opposing sides of its bottom and the rectangular guide opening also has two opposite side openings 4*a* and 4*a'* on opposing sides of its bottom. Only one side opening 4*a* is shown in FIG. 1.

A rectangular insulating substrate 5 is inserted into the case 1 with a predetermined distance between the interior surface of the top of the case 1 and the substrate 5. The substrate 5 has normally-open side contacts 6 and 7 which are disposed beneath the guide openings 3 and 4, respectively. Contacts 6 and 7 are affixed to the substrate 5 by staking or the like. As is most clearly depicted in FIG. 3, the switch of the embodiment further includes T-shaped normally-closed side contact pieces 10 and 11, respectively. The contact piece 10 comprises of a first side portion 10*a* and a second side portion 10*b*, and similarly the contact piece 11 comprises a first side portion 11*a* and a second side portion 11*b*. These contact pieces 10 and 11 are arranged on the insulating substrate 5 so that the second side portions 10*b* and 11*b* respectively confront the normally-open side contacts 6 and 7 from above. The ends of the first side portions 10*a* and 11*a* are bent downwardly and are secured to the insulating substrate 5 by staking or the like. The remaining other ends of the first side portions 10*a* and 11*a* are also bent downwardly and secured to the insulating substrate 5 with connecting pins 12 and 13. The members 10 and 11 are respectively connected to connecting terminals (not shown) by staking the connecting pins 12 and 13 under the insulating substrate 5.

Figure 3:
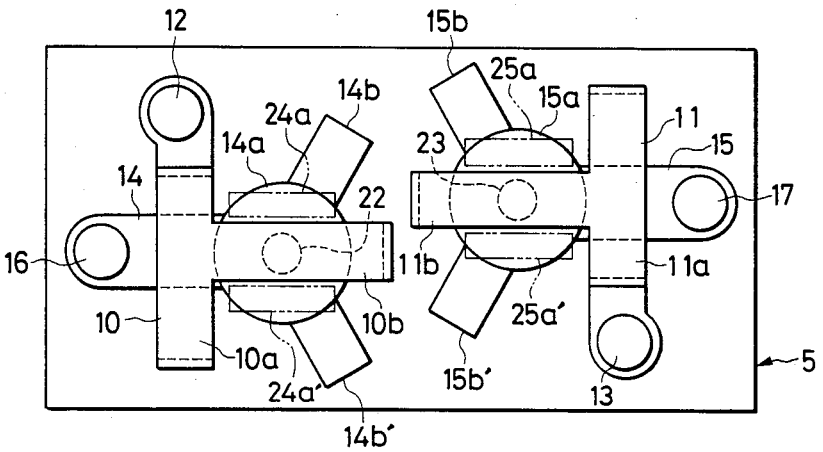
FIG. 3 is a top plan view of the insulating substrate of the embodiment of FIGS. 1–2.

The switch of this embodiment further includes movable contact springs 14 and 15 made of spring material such as beryllium copper. As depicted in FIG. 3, the contact springs have base end portions secured to the right and left portion of the insulating substrate 5 with connecting pins 16 and 17, respectively. Connecting terminals 18 and 19 are respectively connected to the pins 16 and 17 by staking or the like. The top end portions of the movable contact pieces 14 and 15 are formed into curved reversible spring portions 14*a* and 15*a* which are curved upwardly to towards the second side portions 10*b* and 11*b* of contact pieces 10 and 11, respectively. As is most clearly depicted in FIG. 3, a plurality of legs, for instance two legs 14*b* and 14*b'*, extend from the reversible spring portion 14*a*. Similarly, two legs 15*b* and 15*b'* are extended from the reversible spring portion 15*a*, in such a manner that these legs 14*b* and 15*b* are in contact with the insulating substrate 5. Legs 14*b* and 15*b* are depicted in FIG. 1. Contacts 20 and 21 are connected to the lower sides of the reversible spring portions 14*a* and 15*a* of the movable contact springs 14 and 15 at the centers, respectively. Furthermore, contacts 22 and 23 are connected to the upper sides of the reversible spring portions 14*a* and 15*b* at the centers, respectively. The movable contact pieces 14 and 15 are biased upwardly by their elastic forces so that when the switch is in the configuration of FIG. 1, the contacts 22 and 23 are in contact with the second side portions 10*b* and 11*b* of the normally-closed side contact pieces 10 and 11, respectively.

Further, the switch of this embodiment includes closed-top rectangular box-shaped plastic plungers 24 and 25. These plungers 24 and 25 are vertically movable and inserted into the guide openings 3 and 4 of the protrusion 2, respectively. A pair of plunger projections 24*a* and 24*a'* extend from two opposite sides of the lower end of the plungers 24 (cf. FIG. 3) and pass through the openings 3*a* and 3*a'* to contact the upper surface of the reversible spring portion 14*a*. Similarly, a pair of plunger projections 25*a* and 25*a'* extend from two opposite sides of the lower end of the plunger 25 (cf. FIG. 3) and pass through the openings 4*a* and 4*a'* (only one shown) formed in the bottom of the guide opening 4 to contact or approach the respective two positions on the upper surface of the reversible spring portion 15*a*. Furthermore, the pairs of plunger projections 24*a* and 24*a'*, 25*a* and 25*a'* of the plungers 24 and 25 are arranged as to straddle the second side portion 10*b* of the normally-closed side contact piece 10 and straddle the second side portion 11*b* of the normally-closed side contact piece 11, respectively. Compression coil springs 26 and 27 are inserted into the plungers 24 and 25 respectively, in such a manner that each spring is extended between the top of the respective plunger and the bottom of the respective guide opening.

The switch of this embodiment further includes a rectangular-shaped knob having an open bottom. The knob 28 is supported in such a manner that it covers the protrusion 2 and can be tilted to pivot on its axis in the direction of the arrow A and in the opposite direction. Projections 28*a* and 28*b* are formed on the inner surface of the top of the knob 28 in such a manner that they are in contact with the upper surfaces of the plungers 24 and 25, respectively. The knob 28 is held horizontal at its original position through the plungers 24 and 25 by the force of the compression coil springs 26 and 27. The plungers 24 and 25 are designed that they may not come off in the upward direction.

The operation of the switch of FIGS. 1–3 will be described.

Figure 4:
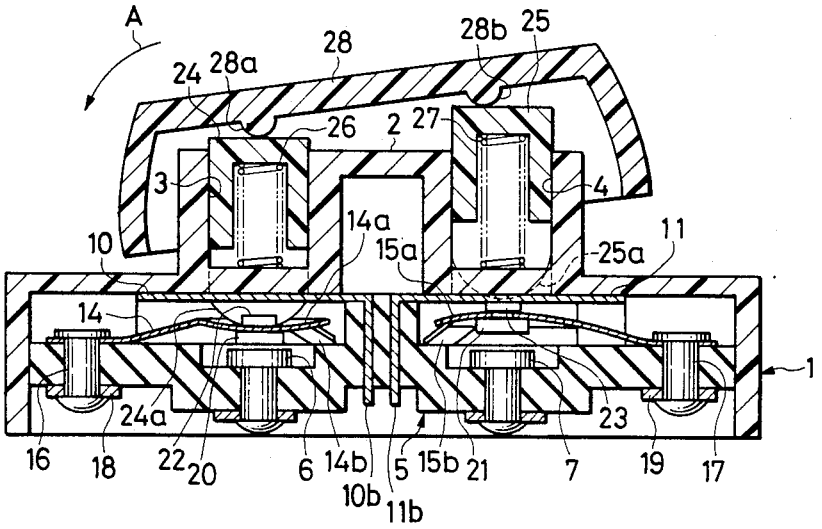
FIG. 4 is a vertical sectional view of the switch of FIG. 1 showing the operation of the switch.

When the knob 28, shown horizontal in FIG. 1, is pivoted in the direction of the arrow A by pushing its left end, the plunger 24 is depressed by means of the projection 28*a*, i.e., it is moved downwardly against the force of compression coil springs 26. As a result, the plunger projections 24*a* and 24*a'* of the plunger 24 are also moved downwardly to push the reversible spring portion 14*a* of the movable contact spring 14 at two locations on the spring. Therefore, as shown in FIG. 4, while the movable contact spring 14 is moved downwardly, or towards the normally-open side contact 6, the contact 22 is moved away from the second side portion 10*b* of the normally-closed side contact piece 10 while the contact 20 is brought into contact with the normally-open side contact 6.

In such a manner, the change-over operation of such a switch has been accomplished. That is, a circuit for rotating a drive motor in the forward direction which is used to move the window glass of an automobile vertically has been completed through the normally-open side contact 6, the movable contact springs 14 and 15, and the normally-closed contact piece 11, such that the window glass is moved downwardly for instance.

When the knob 28 is released, the plunger 24 is returned to the upper position by the force of the compression coil spring 26; that is, the knob 28 is restored to the position shown in FIG. 1. Accordingly, the force applied to the reversible spring portion 14*a* of the movable contact spring 14 by the plunger projections 24*a* and 24*a'* of the plunger 24 is eliminated. As a result, the reversible spring 14*a* is also restored to its original configuration, i.e., curved upwardly. Therefore, the contact 20 is moved away from the normally-open side contact 6 while the contact 22 is brought into contact with the second side portion 10*b* of the normally-closed side contact piece 10.

When the knob 28 is pivoted in the direction of the arrow A, the switch operates as described above. When, on the other hand, the knob 28 is pivoted in the opposite direction, the switch operates substantially in the same manner. That is, when the plunger 25 is depressed, the pair of plunger projections 25*a* and 25*a'* push the reversible spring portion 15*a* of the movable contact spring 15 at the two locations. As a result, the reversible spring portion 15*a* is elastically curved downwardly, so that the contact 23 is moved away from the second side portion 11*b* of the normally-closed side contact piece 11 while the contact 21 is brought into contact with the normally-open side contact 7. Therefore, a circuit for rotating the drive motor in the reverse direction is completed through the normally-open side contact 7, the movable contact springs 15 and 14 and the normally-closed side contact 10, so that the window glass is moved upwardly.

As was described above, in connection with the first embodiment of the invention, one end portion of a spring, namely, the movable contact spring 14 is formed into a reversible spring portion 14*a*, and the legs 14*b* and 14*b*' extend from the other end portion. Similarly, one end portion of the movable contact spring 15 is formed into the reversible spring portion 15*a*, and the legs 15*b* and 15*b*' extend from the other end portion. In such a manner the reversible spring portions 14*a* and 15*a* are normally kept in contact with the second side portions 10*b* and 11*b* of the normally-closed side contact pieces 10 and 11 through the contact springs 14 and 15, respectively. Therefore, the contact pressures of the reversible spring portions 14*a* and 15*a* on the normally-closed side contact pieces 10 and 11 are stable.

As a result, even if the assembling accuracy is not sufficiently high (more specifically the distances between the normally-open side contact 6 and 7 and the second side portions 10*b* and 11*b* of the normally-closed side contact pieces 10 and 11 are not constant), any potential difficulty is absorbed by the elastic displacement of the movable contact springs 14 and 15. Thus, the switch of the invention can be readily manufactured.

Furthermore, in the first embodiment of the invention, the plungers 24 and 25 have the pairs of plunger projections 24*a* and 24*a*', 25*a* and 25*a*' to depress the reversible spring portions 14*a* and 15*a*, respectively. The plunger projections 24*a* and 24*a*' are arranged to be on two locations on the side of (i.e., to straddle) the second side portion 10*b* of the normally-closed side contact piece 10. The plunger projections 25*a* and 25*a*' are arranged so as to be on two side locations of (i.e., to straddle) the upper side of the second side portion 11*b* of the normally-closed side contact piece 11.

Therefore, the first embodiment has the following advantage: In a conventional switch described above, the through-hole for the push rod is formed through the third contact. In order to maintain the current capacity of the contact, it is necessary to increase the area of the third contact as much as that of the through-hole. By contrast, in the switch of the invention, it is unnecessary to form openings through the second side portions 10*b* and 11*b*, and even if the second side portions 10*b* and 11*b* are relatively narrow in width, the current capacity is sufficient.

Figure 5:
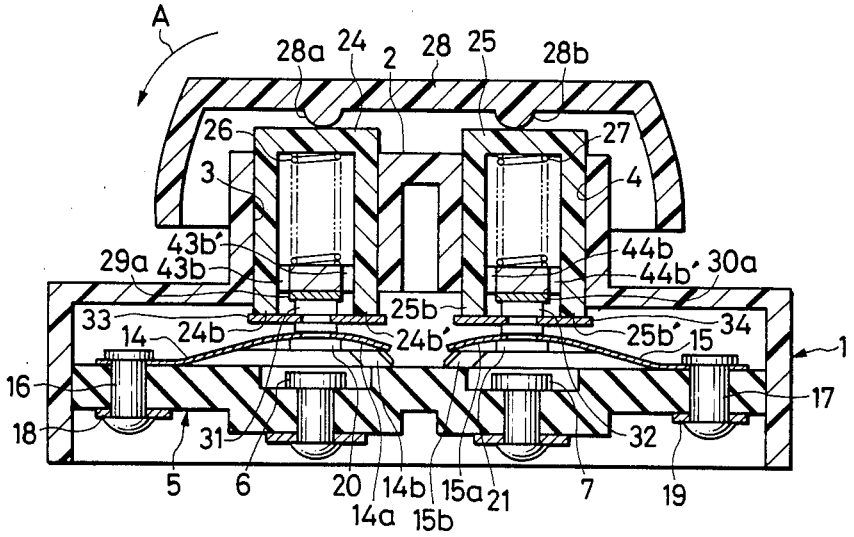
FIGS. 5 through 7 show another embodiment of the invention with the views corresponding respectively to those of FIGS. 1 through 3.
Figure 6:
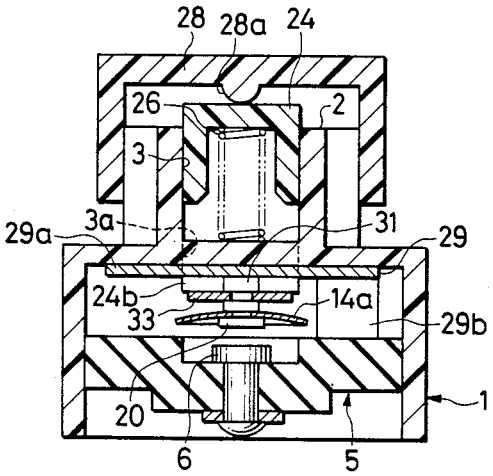
Figure 7:
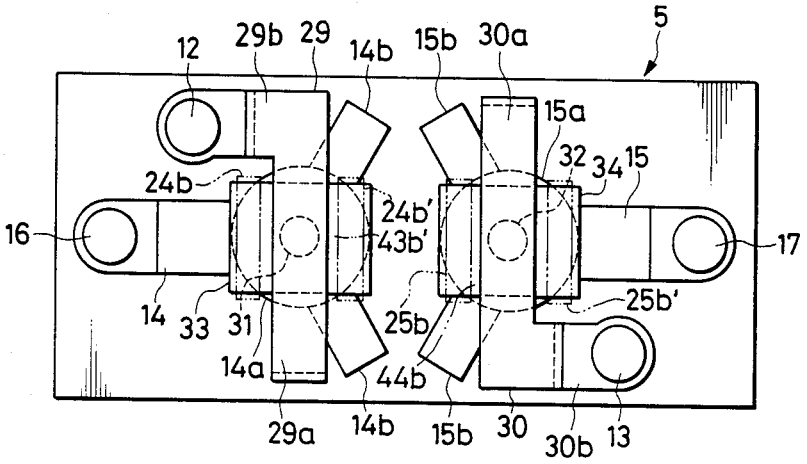

FIGS. 5 through 7 show a second embodiment of the invention. In FIGS. 5 through 7, those components which have been described with reference to FIGS. 1 through 4 are therefore designated by the same reference numerals or characters. Therefore, only the components which are different from those of the first embodiment will be described in detail.

In FIGS. 5 through 7 normally-closed side contact pieces 29 and 30 are employed in place of the normally-closed side contact pieces 10 and 11 described in connection with the first embodiment. The contact piece 29 is L-shaped and comprises a long side portion 29*a* and a short side portion 29*b*, and similarly the contact piece 30 is L-shaped and comprises a long side portion 30*a* and a short side portion 30*b*. The end portions of the long side portions 29*a* and 30*a* are bent downwardly and secured to the insulating substrate 5 by staking or the like. The end portions of the short side portions 29*b* and 30*b* are secured to the insulating substrate 5 with the connecting pins 12 and 13, respectively. Instead of the contacts 22 and 23 of the first embodiment, contacts 31 and 32 are provided on the upper surfaces of the reversible spring portions 14*a* and 15*a*, respectively. The contacts are coupled to plates 33 and 34, respectively. Instead of the side openings 3*a* and 4*a* of the first embodiment, openings 43*b* and 43*b*' and openings 44*b* and 44*b*' are formed in the bottoms of the guide openings 3 and 4 respectively. In such a manner, the openings 43*b* and 44*b* are shifted by 90° from the openings 3*a* and 4*a*, respectively.

Instead of the plunger projections 24*a* and 24*a*', and 25*a* and 25*a*' of the first embodiment, plunger projections 24*b* and 24*b*', and 25*b* and 25*b*' are extended from the lower ends of the plungers 24 and 25, respectively. The plunger projections 24*b* and 24*b*' are passed through the aforementioned openings 43*b* and 43*b*' to abut against the plate 33 at two positions. Similarly, the plunger projections 25*b* and 25*b*' are passed through the openings and 44*b* and 44*b*' to abut against the plate 34 at two positions. That is, the plunger projections 24*b* and 24*b*' are arranged to straddle the long side portion 29*a* of the normally-closed side contact piece, and similarly the plunger projections 25*b* and 25*b*' are arranged to straddle the long side portion 30*a* of the normally-closed side contact piece 30. The contacts 31 and 32 of the reversible spring portions 14*a* and 15*a* are normally held in contact with the long side portions 29*a* and 30*a* of the normally closed-side contact pieces 29 and 30 by the elastic forces of the movable contact pieces 14 and 15, respectively.

When the knob 28 is rocked in the direction of the arrow A (or in the opposite direction) to press the plunger 24 (or 25), the plunger projections 24*b* and 24*b*' (or 25*b* and 25*b*') press the plate 33 (or 34). As a result, the reversible spring portion 14*a* (or 15*a*) is pressed by means of the contact 31 (or 32) so that it is elastically curved downwardly. Thus, the second embodiment provides the same effect as the first embodiment; however, it should be noted that, in the second embodiment, the center of the reversible spring portion 14*a* (or 15*a*) is pressed by means of the contact 31 (or 32), and therefore the reversing action is smoothly and positively carried out.

While preferred embodiments of the invention have been described, it should be noted that the invention is not limited thereto. For instance, the technical concept of the invention is applicable not only to the above-described window regulator of an automobile but also to all change-over switches of the type that the operator feels the operation of the switch through the action of the reversible spring means. That is, it will be obvious to those skilled in the art that various changes and modifications may be made without departing from the invention as defined by the appended claims and their equivalents.

What is claimed is:

1. A switch comprising:

a case;

an insulating substrate supported in said case;

a normally-open-side contact secured to said insulating substrate;

a normally-closed-side contact piece secured to said insulating substrate in such a manner as to confront said normally-open-side contact;

a movable contact spring, having an end portion formed into a reversible curved spring portion curved toward said normally-closed-side contact piece, said movable contact spring further having legs extending from said reversible curved spring portion, said legs being in contact with said insulating substrate, said reversible curved spring portion having a contact member normally held in contact with said normally-closed-side contact piece by an elastic force of said movable contact spring; and at least one plunger mounted through said case having a pair of projections, each projection on an opposite side of said normally-closed-side contact piece, wherein depression of said plunger engages said pair of projections with said reversible spring portion, depresses said reversible spring portion of said movable contact spring, curves said reversible spring portion towards said normally-open-side contact for causing a reverse curving of said reversible spring portion, and brings said contact member on said reversible spring portion into contact with said normally-open-side contact.

2. The switch of claim 1 wherein said plunger includes spring means to bias said plunger in a direction away from said movable contact spring.

3. The switch of claim 1 wherein said movable contact spring is generally Y-shaped with said legs comprising two extremities of said contact spring, the end of said contact spring opposite said legs being fastened to said substrate.

4. The switch of claim 1 wherein said contact piece is T-shaped with each extremity of said contact piece fastened to said substrate.

5. The switch of claim 1 wherein said contact piece is L-shaped with each extremity of said piece fastened to said substrate.

6. The switch of claim 1 wherein said reversible curved spring portion has a convex surface facing said plunger when said projections are separated therefrom, said spring portion being concave facing said plunger upon contact from said projections.

* * * * *